US010355345B2

(12) United States Patent
Wechselberger

(10) Patent No.: US 10,355,345 B2
(45) Date of Patent: Jul. 16, 2019

(54) BROADBAND OMNIDIRECTIONAL ANTENNA, IN PARTICULAR FOR RAIL VEHICLES, AND RAIL VEHICLE OF THIS TYPE

(71) Applicant: Kathrein-Werke KG, Rosenheim (DE)

(72) Inventor: Stefan Wechselberger, Schechen (DE)

(73) Assignee: Kathrein SE, Rosenheim (DE)

( * ) Notice: Subject to any disclaimer, the term of this patent is extended or adjusted under 35 U.S.C. 154(b) by 71 days.

(21) Appl. No.: 15/658,676

(22) Filed: Jul. 25, 2017

(65) Prior Publication Data

US 2018/0034138 A1 Feb. 1, 2018

(30) Foreign Application Priority Data

Jul. 29, 2016 (DE) ..... 10 2016 114 093

(51) Int. Cl.

| | |
|---|---|
| ***H01Q 1/32*** | (2006.01) |
| ***H01Q 9/40*** | (2006.01) |
| *H01Q 1/42* | (2006.01) |
| *H01Q 1/36* | (2006.01) |

(52) U.S. Cl.

CPC ..... *H01Q 1/32* (2013.01); *H01Q 1/3275* (2013.01); *H01Q 9/40* (2013.01); *H01Q 1/36* (2013.01); *H01Q 1/42* (2013.01)

(58) Field of Classification Search

CPC ..... H01Q 1/32; H01Q 1/3275; H01Q 9/40; H01Q 1/36; H01Q 1/42

See application file for complete search history.

(56) References Cited

U.S. PATENT DOCUMENTS

| | | | | |
|---|---|---|---|---|
| 6,023,245 | A | 2/2000 | Gomez et al. | |
| 2017/0025750 | A1* | 1/2017 | Su | H01Q 1/36 |
| 2018/0219282 | A1* | 8/2018 | Hefele | H01Q 9/40 |

FOREIGN PATENT DOCUMENTS

| | | | |
|---|---|---|---|
| DE | 103 59 605 | | 7/2005 |
| DE | 10 2013 012 308 | | 1/2015 |
| EP | 3 121 897 | | 1/2017 |
| WO | 2007/048258 | A1 | 5/2007 |
| WO | 2015/069309 | A1 | 5/2015 |
| WO | 2016/008607 | A1 | 1/2016 |

* cited by examiner

*Primary Examiner* — Dameon E Levi
*Assistant Examiner* — David E Lotter
(74) *Attorney, Agent, or Firm* — Nixon & Vanderhye P.C.

(57) ABSTRACT

A broadband omnidirectional antenna for rail vehicles comprises a baseplate and a monopole radiator, which comprises a foot point and an opposing end region. The radiator extends away from the baseplate and widens in cross section along the longitudinal axis thereof in at least a first portion located between the foot point thereof and the end region thereof, diverging walls of the radiator forming an accommodating chamber. An inner contour of a shell-shaped or trough-shaped holding and/or accommodating device is adapted at least over part of the periphery to an outer contour of the first portion of the radiator, resulting in at least part of at least the first portion of the radiator dipping into the holding and/or accommodating device and being held thereby. The first end of a holding means is fixed to the baseplate and a second end thereof is fixed to the radiator.

20 Claims, 6 Drawing Sheets

BROADBAND OMNIDIRECTIONAL ANTENNA, IN PARTICULAR FOR RAIL VEHICLES, AND RAIL VEHICLE OF THIS TYPE

CROSS-REFERENCE TO RELATED APPLICATIONS

This application claims priority from DE Patent Application No. 10 2016 114 093.7 filed Jul. 29, 2016, the entire contents of which are hereby incorporated by reference.

FIELD

The technology herein relates to a broadband omnidirectional antenna which is used in particular in rail vehicles, and to a rail vehicle of this type.

BACKGROUND AND SUMMARY

Omnidirectional antennae are multi-band capable as a result of the broadband nature thereof, and preferably radiate in vertical polarisation. When used in rail vehicles, such as locomotives or carriages, it is thus achieved that the vehicle can be linked for communication with a base station.

DE 103 59 605 A1 discloses an omnidirectional antenna which is attached inside buildings as an indoor antenna. The omnidirectional antenna comprises a monopole radiator which has a conical portion and is arranged at a distance above a baseplate or a counterweight surface. The monopole radiator is connected via the foot point thereof to the baseplate or the counterweight surface and is also held by means of an inner hood which encloses the monopole radiator. The inner hood is itself in turn enclosed by an outer hood.

A drawback of the antenna disclosed in DE 103 59 605 A1 is that the antenna is difficult to assemble and does not have sufficient resistance to vibrations such as may occur for example in rail vehicles. Among other things, these vibrations are due to vibrations caused by the drive device (for example a diesel engine) or due to laying gaps in the track itself, which make it possible for the track to expand at higher temperatures without deformation.

The example non-limiting technology herein provides a broadband omnidirectional antenna and a rail vehicle comprising an omnidirectional antenna of this kind which do not have the drawbacks of the prior art. The broadband omnidirectional antenna ought to be manufactured in a simpler manner, be able to permanently withstand the loads occurring when used in rail vehicles and be capable of very broadband operation.

The object is achieved for the broadband omnidirectional antenna, a corresponding rail vehicle, advantageous embodiments of the broadband omnidirectional antenna, and an advantageous embodiment of the rail vehicle.

The broadband omnidirectional antenna comprises a baseplate and a monopole radiator, which comprises a foot point and an end region, the end region being arranged opposite the foot point. The radiator extends along a longitudinal axis extending perpendicularly or predominantly perpendicularly to the baseplate. This means that the radiator extends away from, in other words rises from, the baseplate, the foot point thereof being arranged closer than the end region thereof to the baseplate. The radiator widens in cross section along the longitudinal axis thereof in at least a first portion located between the foot point thereof and the end region thereof, the walls of the radiator, which thus diverge, delimiting an accommodating chamber. The omnidirectional antenna further comprises at least one shell-shaped or trough-shaped holding and/or accommodating device. A holding and/or accommodating device inner contour is adapted at least over part of the periphery to an outer contour of the first portion of the radiator, resulting in at least part of at least the first portion of the radiator dipping into the holding and/or accommodating device and being held in particular form-fittingly thereby. The omnidirectional antenna also further comprises a holding means, the first end of which is fixed to the baseplate and the second end of which, opposite the first end, is fixed directly or indirectly to the radiator.

The use of the shell-shaped or trough-shaped holding and/or accommodating device, which may be funnel-shaped at least in a peripheral sub-region and serves as a centring aid for accommodating the radiator during assembly as well as permanently bracing said radiator after assembly is complete, is particularly advantageous. In this context, a large support surface of the radiator is form-fittingly positioned on the holding and/or accommodating device. This support surface is preferably several square centimeters, in particular more than 3 or more than 5 or more than 7 or more than 10 or more than 15 or more than 20 $cm^2$. As a result, very high stability is achieved. To increase the stability further, the holding means is rigidly connected both to the baseplate and to the radiator itself. In this context, the baseplate is preferably connected to the rail vehicle via a screw connection. The omnidirectional antenna thus produced is very mechanically stable in construction and can also be manufactured in a very simple manner in terms of production. During final assembly, there are absolutely no solder connections, as is explained in greater detail below. At the same time, the electrical properties of the omnidirectional antenna are approximately constant over the entire service life.

As is already apparent from the term "omnidirectional", the antenna radiates omnidirectionally. As a result of the achievable broadband nature, all the conventional frequency ranges, such as GSM, UMTS and LTE, can be covered. The antenna also operates in particular at upper boundary frequencies of over 2500 MHz or 3000 MHz or 3500 MHz or 4000 MHz or 4500 MHz or 5000 MHz or 5500 MHz. Preferably, it can be operated in a frequency range of from 697 MHz to 6000 MHz. In principle, use for lower and higher frequencies is also conceivable.

In a further embodiment, the omnidirectional antenna comprises a supporting and fixing portion, which is part of or is connected to the holding and/or accommodating device. The supporting and fixing portion is thus preferably fixed to an outer contour of the shell-shaped or trough-shaped holding and/or accommodating device via connecting elements. In this context, a support surface of the supporting and fixing portion is positioned on and/or screwed to the baseplate. This support surface extends preferably rectangularly away from the holding and/or accommodating device, in such a way that the centre of gravity of the support and fixing portion preferably does not coincide with the longitudinal axis which passes through the radiator and the holding and/or accommodating device. The support and fixing portion may also be referred to as a foot portion.

In an advantageous embodiment, the radiator comprises a second portion, the cross section remaining constant in the second portion. In this context, the second portion is either directly connected to the first portion or spaced apart from the first portion by a further portion. This does slightly increase the construction height of the omnidirectional antenna, but in return the bandwidth over which the omnidirectional antenna can be operated is greatly increased.

In a particularly advantageous embodiment, the height of the first portion and the height of the second portion vary along the longitudinal axis in the peripheral direction of the radiator. By way of the variation, the bandwidth of the omnidirectional antenna can be influenced. In this context, it is also possible for the radiator to have an asymmetrical cross section in the cross section thereof transverse to the longitudinal axis thereof. In this case, it could have a cross section in the shape of a part-circle in a first sub-region and one or more cross-sectional regions extending in a straight manner in another sub-region. In principle, it is thus possible for the radiator to be conical in one peripheral sub-region and cubic in other peripheral sub-regions. These two regions may even be formed simultaneously along a particular height, in other words along a length along the longitudinal axis. Preferably, the end region of the radiator is predominantly rectangular or square in a plan view.

Preferably, a bridge-like connecting portion is provided, which is arranged on the radiator or on the holding means and connects the radiator to the holding means and the holding means to the radiator. In this context, the connecting portion preferably extends, with a radial component, outwardly away from the radiator with respect to the longitudinal axis, or the connecting portion extends, with a radial component, in the direction of the radiator with respect to the longitudinal axis. In this context, the holding means is rigidly connected to the end of the connecting portion arranged furthest away from the radiator. Conversely, in the other embodiment the same applies to the radiator, which is thus rigidly connected to the end of the connecting portion furthest away from the holding means. The connecting portion is in particular arranged at the end region of the radiator. As a result, very high stability is achieved.

Preferably, the holding means is formed in a single piece together with the connecting portion and the radiator. This means that they consist of a common part and are preferably manufactured jointly by casting. In this context, the holding means is galvanically connected to the radiator. In principle, it would also be possible for the holding means and the radiator to consist of two separate parts, the connecting portion being part of either the holding means or the radiator. The holding means and the radiator are thus rigidly interconnected, in particular by a screw connection.

Advantageously, the radiator consists of metal or a metal alloy or comprises metal or a metal alloy. Alternatively, it could also consist of a dielectric, the outer face and/or inner face being provided with an electrically conductive layer. In the latter case, the radiator could be manufactured by plastics injection moulding. The same also applies to the holding means.

As a result of the use of the shell-shaped or trough-shaped holding and/or accommodating device, sufficient stability of the omnidirectional antenna is provided even if the omnidirectional antenna comprises exactly one holding means. This means that the radiator is electrically conductively connected, in a mechanically stable manner, to one point on the baseplate merely via the exactly one holding means. A holding means may also mean a column. In this context, the holding means is connected to the baseplate at exactly one point. As a result, manufacturing costs can be further reduced.

Advantageously, the omnidirectional antenna comprises a supply means for supplying the radiator at the foot point thereof. The supply means extends from the foot point in the direction of the baseplate. A plug element, preferably in the form of a socket (for example an N socket), is arranged on a lower face of the baseplate, which is opposite the mounting face having the accommodated radiator. A power cable, in particular in the form of a coaxial cable, can be connected to this plug element. On the lower face thereof, the baseplate preferably comprises an accommodating opening for the plug element. In relation thereto, the plug element preferably has an external thread which corresponds to an internal thread of the accommodating opening, in such a way that the plug element can be screwed into the accommodating opening of the baseplate. When the omnidirectional antenna is assembled, at least the first end of the supply means extends into the plug element, the first end of the supply means being designed to accommodate and electrically contact an internal conductor of the power cable. The first end of the supply means may be slotted in the longitudinal direction, resulting in a spring effect. As a result of this spring effect, reproducible electrical contact between the supply means and the internal conductor to be accommodated of the power cable can be achieved. In this context, the supply means is itself galvanically separated from the baseplate. Preferably, the supply means is connected to the radiator galvanically but without soldering, or alternatively it is capacitively coupled thereto.

In a further embodiment, the supply means comprises an external thread over a sub-length at the second end thereof. By means of this external thread, the supply means is or can be screwed into a corresponding internal thread at the foot point of the radiator, preferably with a defined torque, resulting in galvanic contact. If merely one capacitive coupling is desired, a dielectric, in particular in the form of a sleeve, may be arranged between the foot point of the radiator and the supply means. In a further embodiment, the sleeve may have an internal and an external thread, the external thread of the supply means being capable of being screwed into the internal thread of the dielectric sleeve. The external thread of the dielectric sleeve can in turn be mechanically connected to a corresponding internal thread at the foot point of the radiator. How far the supply means extends through the foot point into the accommodating space of the radiator may be adjusted as desired.

In a particularly advantageous embodiment, the omnidirectional antenna comprises a GNSS (global navigation satellite system) module. By means of a GNSS module of this type, the position of the omnidirectional antenna and thus of the rail vehicle can be determined. A GNSS module of this type may for example be GPS, GLONASS (global navigation satellite system), Galileo and/or Beidou. In this context, the GNSS module is arranged in the accommodating chamber of the radiator, in the end region thereof. As a result, the GNSS module is attached in a compact manner whilst stilling having good reception of the satellite navigation signals.

Preferably, when the omnidirectional antenna is assembled the GNSS module does not actually even extend past the end region of the radiator, and is thus located entirely within the antenna accommodating chamber.

So as to be able to fix the GNSS module sufficiently, in a further embodiment the radiator comprises at least one support shoulder (preferably a plurality of support shoulders) which extends from the inner face of the radiator, in other words starting from the inner contour of the radiator, into the accommodating chamber thereof. In this context, the GNSS module is positioned on the at least one support shoulder. This ensures that the position of the GNSS module does not change within the accommodating chamber, potentially impairing reception, even if vibrations occur.

In a preferred embodiment, the holding means comprises an accommodating groove, which is accessible from the outside and which extends over the entire length of the holding means and over the connecting portion, which is part of either the holding means or the radiator itself. In this case, this accommodating groove opens into the accommodating chamber of the radiator. As a result, a connection cable for powering the GNSS module can be introduced into the accommodating groove. This connection cable can be passed through the baseplate via a hole therein.

Also preferably, the omnidirectional antenna comprises a further cover hood, which is form-fittingly and/or frictionally connected to the baseplate and encloses both the radiator and the holding means and the holding and/or accommodating device, and prevents moisture from penetrating into the omnidirectional antenna. Also preferably, either the GNSS module may be screwed to the one or more support shoulders via one or more screw connections or a spring force which presses the module onto the support shoulders can be applied to the GNSS module by a spring element. A spring element of this type could be arranged between the hood and either the end region of the radiator or the GNSS module.

The rail vehicle is in particular a locomotive or a railway carriage. In this context, the rail vehicle is equipped with the broadband omnidirectional antenna. Preferably, the omnidirectional antenna is attached to the roof of the locomotive or motor trainset or of the railway carriage.

Preferably, the rail vehicle is driven electrically, drawing or being capable of drawing the electrical power from an overhead line. In this context, the holding means is selected or adjusted in terms of the diameter thereof and/or the electrical resistance thereof in such a way that the holding means can act as a fuse if the overhead line is released from the anchoring thereof and falls on the broadband antenna. In this case, a bolted short circuit would occur, and this could result in the control technology inside the train detecting the short circuit current and disconnecting the corresponding network segment. At the same time, the accommodating means connected to the radiator would be protected from damage.

Naturally, the omnidirectional antenna could also be installed on other vehicles, such as motor vehicles (for example cars or heavy goods vehicles) or ships or other means of transport such as underground trains or trams.

BRIEF DESCRIPTION OF THE DRAWINGS

Various non-limiting illustrative embodiments are disclosed in the following by way of example with reference to the drawings. Like objects have the same reference signs. In the corresponding drawings, in detail.

DETAILED DESCRIPTION OF ILLUSTRATIVE NON-LIMITING EMBODIMENTS

Figure 1:
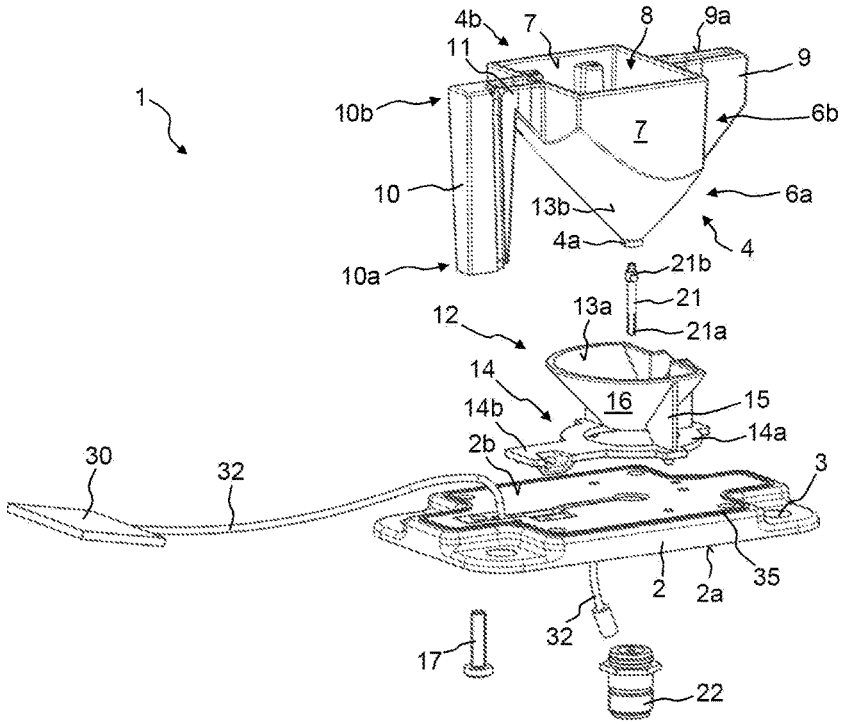
FIG. 1 is a three-dimensional drawing of an omnidirectional antenna in an exploded view.

FIG. 1 is a three-dimensional drawing of the broadband omnidirectional antenna 1 in an exploded view. The antenna 1 comprises a baseplate 2, which preferably has a square or rectangular cross section. The baseplate 2 may be screwed onto a rail vehicle. For this purpose, the baseplate 2 comprises corresponding (threaded) holes 3. The baseplate 2 comprises a lower face 2*a* which points in the direction of the support surface of the rail vehicle and an upper face 2*b*, also referred to as the mounting face 2*b*. The antenna 1 further comprises a monopole radiator 4, which comprises a foot point 4*a* and an end region 4*b* opposite the foot point, the radiator 4 comprising a longitudinal axis 5 (see FIG. 2) which extends predominantly perpendicularly to the baseplate 2.

When assembled, the radiator 4 rises from the baseplate 2. In this context, the foot point 4*a* of said radiator is arranged closer than the end region 4*b* thereof to the baseplate 2.

Figure 2:
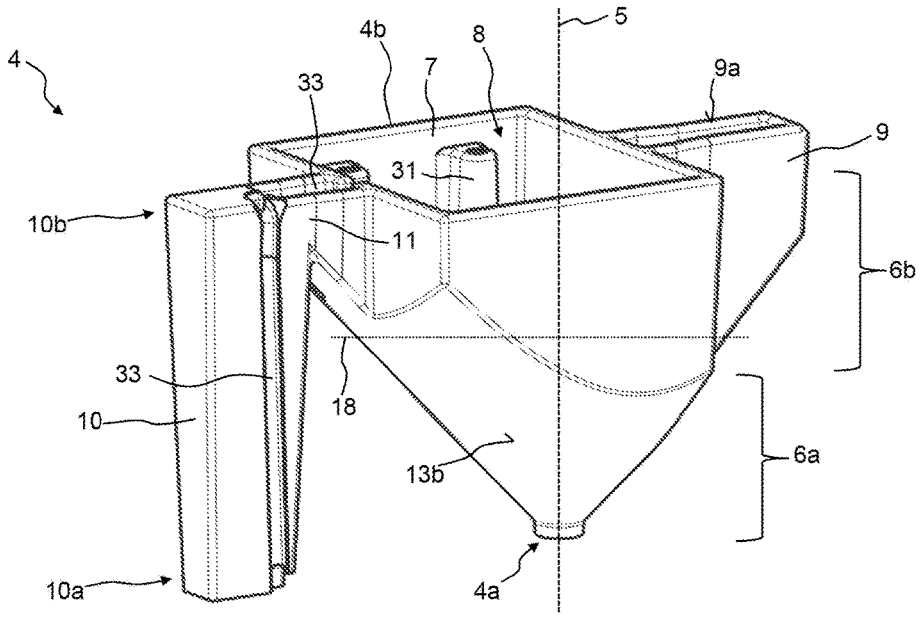
FIG. 2 is an enlarged three-dimensional drawing of a monopole radiator.

The radiator 4 widens in cross section along the longitudinal axis 5 thereof in at least a first portion 6*a* located between the foot point 4*a* thereof and the end region 4*b* thereof. The side walls of the radiator 4, which thus diverge, delimit an accommodating chamber 8. FIG. 2 is an enlarged view of the radiator 4.

Referring to FIG. 2, a cross section of the radiator 4 remains constant in a second portion 6*b*, the second portion 6*b* being directly connected to the first portion 6*a* in this embodiment. It would also be possible for the second portion 6*b* to be spaced apart from the first portion 6*a* by a further portion. The first and the second portion 6*a*, 6*b* preferably extend along the longitudinal axis 5.

Referring to FIG. 2, it can be seen that the height of the first portion 6*a* and the height of the second portion 6*b* vary along the longitudinal axis 5 in the peripheral direction of the radiator 4. This means that the first portion 6*a* extends over a greater height (in parallel with the longitudinal axis 5) in one peripheral sub-region of the radiator 4 than in another peripheral sub-region. The same likewise applies to the second portion 6*b*.

This further means that the radiator 4 has an asymmetrical cross section in the cross section thereof transverse to the longitudinal axis 5 thereof. Thus, there is a sub-region in which the cross section is at least in the shape of a part-circle and there is another sub-region in the same cross-sectional view which has at least one and preferably a plurality of cross-sectional regions extending in a straight manner. This would be the case for example in a cross section along the dotted line through the plane 18.

In other words, this means that the radiator 4 is shaped conically in one peripheral sub-region and cubically in another peripheral sub-region. Preferably, the extension is predominantly cubic in the second portion 4*b* and substantially conical in the first portion 4*a*.

The end region 4*b* of the radiator 4 is rectangular or square. It could also have a different cross-sectional shape and could in principle also be kept n-gon-shaped.

At an end region 4*b* thereof, on at least one face 7 and over at least part of the width, the radiator 4 comprises a protruding extension portion 9 which extends along the longitudinal axis 5 in the direction of the baseplate 2. This extension portion 9 preferably extends, with a radial component, outwardly and away with respect to the longitudinal axis 5. The upper face 9*a* thereof preferably ends so as to be flush with the end region 4*b* of the radiator 4 and does not project past the end region 4*b* of the radiator 4. The extension portion 9 extends in the direction of the foot point 4*a* of the radiator 4 in the direction of the longitudinal axis 5. However, it tapers in the direction of the longitudinal axis the further it extends in the direction of the foot point 4*a*.

The side walls of the extension portion 9 likewise enclose a further accommodating chamber. This further accommodating chamber is preferably separated from the accommodating chamber 8 of the radiator 4. However, this need not necessarily be the case.

The omnidirectional antenna 1 further comprises a holding means 10. This holding means 10 is rigidly connected to the radiator 4, in particular being rigidly connected to the radiator 4 at the end region 4*b* thereof. Preferably, the holding means 10 and the radiator 4 consist of a common cast part, which can be manufactured in particular by die casting (for example aluminium die casting). It would also be possible for the holding means 10 and the radiator 4 to be formed by separate parts, which can preferably be rigidly mechanically interconnected via a screw connection. The accommodating chamber 8 of the radiator 4 is preferably free of the holding means 10. The height of the radiator 4 is preferably not increased or influenced by the holding means 10.

The holding means 10 comprises a first end 10*a* which is or can be connected to the baseplate 2 via a screw connection 17. In this context, the screw of the screw connection 17 is preferably passed through the baseplate 2 via the lower face 2*a* thereof and thereby screwed into the lower face of the first end 10*a* of the holding means 10. This can be seen in the sectional drawing of FIG. 5.

The holding means 10 is preferably connected to the radiator 4 via a bridge-like connecting portion 11. In this context, the connecting portion 11 may be formed in a single piece with the holding means 10 or in a single piece with the radiator 4. If the holding means 10 and the radiator 4 consist of a common part, the connecting portion 11 is also part thereof. The connecting portion 11 is arranged at the second end 10*b*, in other words the upper end 10*b*, of the holding means 10, and extends, with a radial component, in the direction of the radiator 4 with respect to the longitudinal axis 5. In this context, the radiator 4 is rigidly connected to the end of the connecting portion 11 arranged furthest away from the holding means 10. In this case, a connection of this type would preferably take place via a screw connection. It would also be possible for the radiator 5 to have a connecting portion 11 of this type arranged on the end region 4*b* thereof. In this case, the connecting portion 11 would extend, with a radial component, outwardly, in other words away from the radiator 4, in the manner of a bridge with respect to the longitudinal axis 5. In this context, the holding means 10 would be connected at the upper end 10*b* thereof to the end of the connecting portion 11 arranged furthest away from the radiator 4. A connection of this type would preferably likewise be a screw connection again. Other types of connection would also be conceivable here. However, a connecting portion 11 need not necessarily be present. The holding means 10 could also be arranged directly on the radiator 4. However, both connection types are referred to as a "direct" connection between the holding means 10 and the radiator 4. However, there could also be further parts arranged therebetween which are not formed in a single piece with either the holding means 10 or the radiator 4, such as the connecting portion 11. This would be referred to as an "indirect" connection between the holding means 10 and the radiator 4. It should further be emphasised that the holding means 10 and the radiator 4 preferably consist of a common cast part. The holding means 10 is formed in particular in an L shape or in an approximation to an L shape with the connecting portion 11.

The holding means 10 and the holding and/or accommodating device 12 are preferably formations separate from one another which are arranged on the shared baseplate 2 and in particular screwed thereto. They are therefore not formed by a common cast or moulded part (in a single piece).

The radiator 4 preferably consists of metal or a metal alloy and comprises metal or a metal alloy. In principle, it could also consist of a dielectric, the outer face and/or the inner face thereof being coated with an electrically conductive layer.

The holding means 10 preferably likewise consists of metal or a metal alloy or comprises metal or a metal alloy.

The same naturally also applies to the bridge-like connecting portion 11.

The radiator 4 is electrically conductively, in other words galvanically, connected, for example via the end region 4*b* thereof, to the holding means 10, which is in turn electrically conductively, in other words galvanically, connected to the baseplate 2.

In this context, the omnidirectional antenna 1 preferably comprises at least one holding means 10. This means that merely one side wall 7 of the radiator 4 is connected to the holding means 10. The arrangement of the exactly one holding means 10 on the radiator 4 is therefore asymmetrical. As a result, manufacturing costs can be reduced.

The radiator 4 is funnel-shaped, at least in portions.

So as to be able to stabilise the radiator 4 even better on the baseplate 2, the omnidirectional antenna 1 comprises a shell-shaped or trough-shaped holding and/or accommodating device 12. An inner contour 13*a* of the holding and/or accommodating device 12 is adapted at least over part of the periphery to an outer contour 13*b* of the first portion 6*a* of the radiator 4. This makes it possible for at least part of at least the first portion 6*a* of the radiator 4 to dip into the holding and/or accommodating device 12 and to be held thereby in particular form-fittingly and without tools. This connection is preferably without a frictional connection (for example screw connection) and in particular without a bonded connection (for example solder connection).

The holding and/or accommodating device 12 consists of a dielectric, in particular made of plastics material, and may for example be manufactured by plastics injection moulding.

The omnidirectional antenna 1 preferably further comprises a support and fixing portion 14, which is fixed to the shell-shaped or trough-shaped holding and/or accommodating device 12 via connecting elements 15. In this context, the connecting elements 15 are attached to an outer contour 16 of the holding and/or accommodating device 12. The support and fixing portion 14 comprises a first, preferably circular segment 14*a* through which an opening passes in the centre. A second, preferably square or rectangular segment 14*b* which can be connected to the baseplate 2 via a screw connection, is preferably connected to said first segment. The connecting elements 15 are arranged on the first segment 14*a*. In a plan view of the holding and/or accommodating device 12, the second segment 14*b* protrudes laterally on at least one side or on exactly one side. This increases the required support surface via which the support and fixing portion 14 is supported on the baseplate 2.

The holding and/or accommodating device 12 is preferably manufactured in a single piece together with the support and fixing portion 14. Further, this is preferably achieved by joint plastics injection moulding.

As stated above, the radiator 4 is form-fittingly held on part of the length of the first portion 4*a* over part of the periphery by the holding and/or accommodating device 12. This means that the holding and/or accommodating device 12 is also funnel-shaped in part. It preferably comprises a widening for accommodating the extension portion 9 of the radiator 4.

Figure 3:
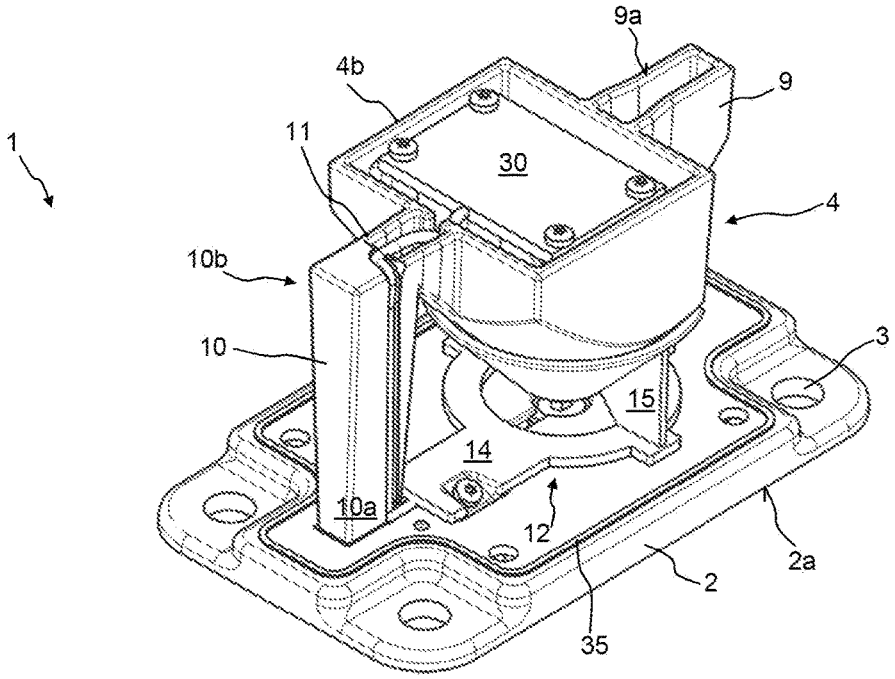
FIG. 3 is a three-dimensional drawing of the omnidirectional antenna.
Figure 4A:
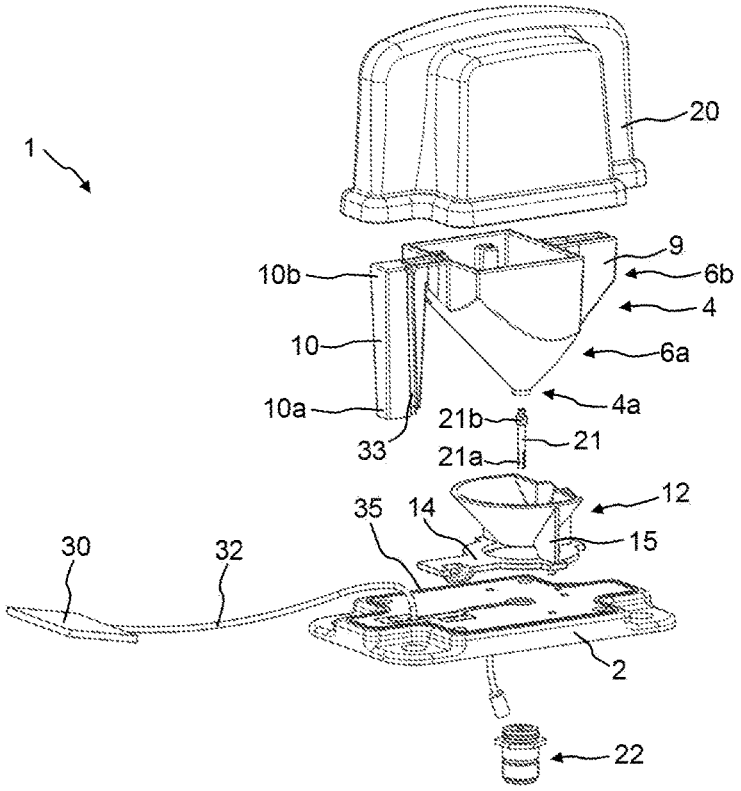
FIG. 4A, 4B are further three-dimensional drawings of the omnidirectional antenna in an exploded view, a cover hood additionally being shown.
Figure 4B:
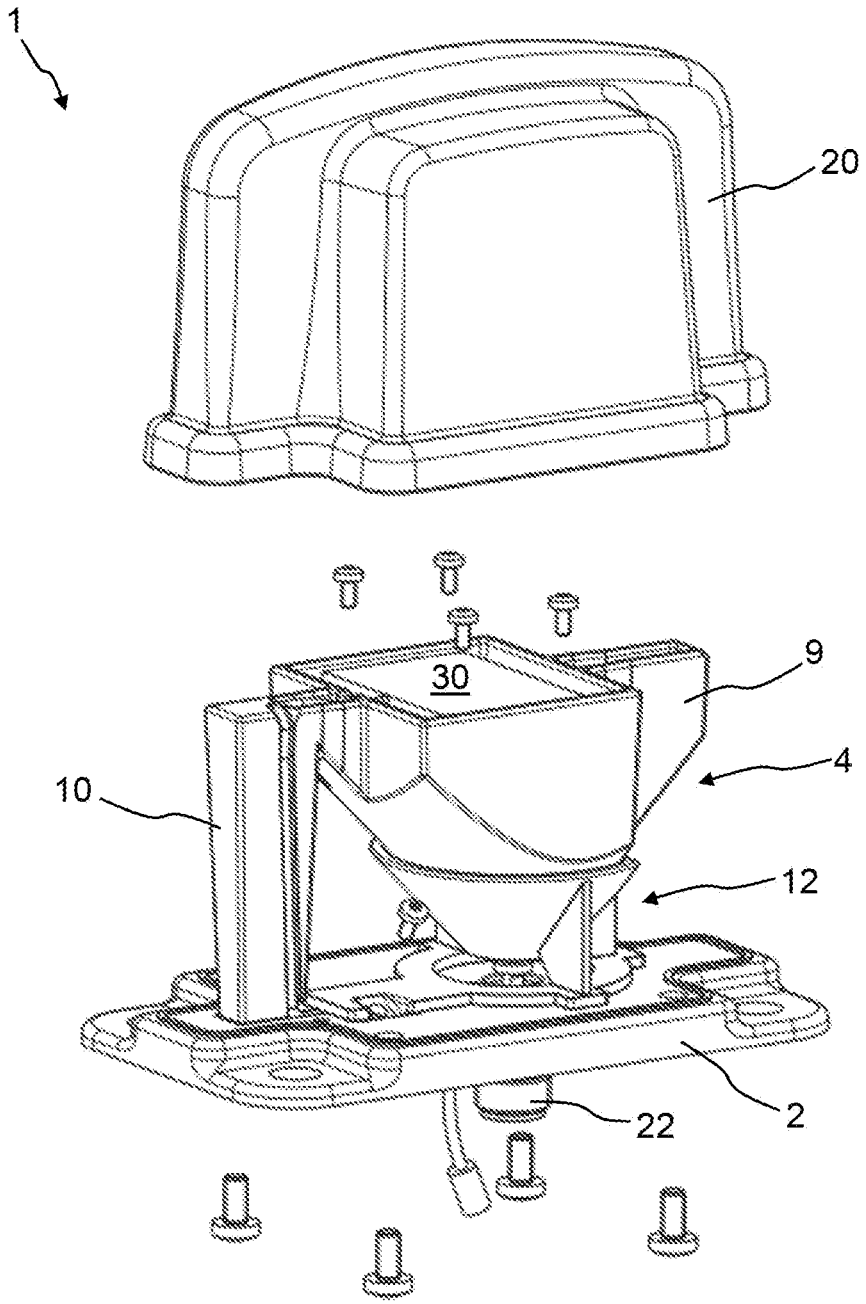
Figure 5:
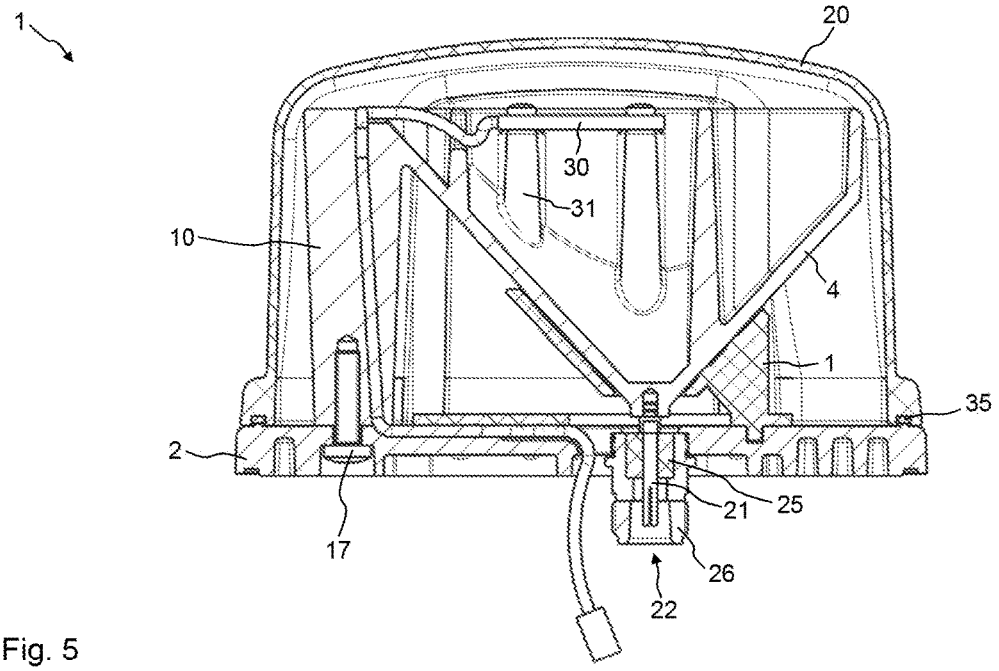
FIG. 5 is a longitudinal section through the omnidirectional antenna.

FIG. 3 shows the omnidirectional antenna 1 when assembled, an additional cover hood 20 only being shown in FIGS. 4A, 4B and 5.

FIG. 5 is a sectional view through the omnidirectional antenna 1. A supply means 21, such as can also be seen for example in FIG. 1, is shown at the foot point 4*a* of the radiator 4. The supply means 21 is preferably formed in a single piece, and extends from the foot point 4*a* of the radiator 4 in the direction of the baseplate 2. A plug element 22, in particular in the form of a socket (for example an N socket), is arranged on a lower face 2*a* of the baseplate 2 which is opposite the mounting face 2*b*, the plug element 22 being connectable to a power cable, in particular in the form of a coaxial cable. When the omnidirectional antenna is assembled, the supply means 21 preferably forms the internal conductor of the plug element 22. In this case, the supply means 21 is electrically conductively connectable or connected to an internal conductor of the power cable which is accommodated or is to be accommodated. For this purpose, the supply means 21 is preferably slotted in the longitudinal direction at the first end 21*a* thereof, so as thus to be better able to accommodate and electrically conductively contact the internal conductor of the coaxial cable to be accommodated. The plug element 22 is therefore preferably formed by a plurality of parts. It comprises a housing or an external conductor 26 and a dielectric 25. Depending on the perspective, the supply means 21 is also part of the plug element 22.

The supply means 21 is preferably pin-shaped, and is further galvanically separated from the baseplate 2. The supply means 21 is preferably connected to the radiator 4 galvanically but without soldering, or alternatively capacitively coupled thereto. In particular, the supply means 21 comprises, over part of the length at the second end 21*b* thereof, an external thread which is screwed into the radiator 4 in a corresponding internal thread at the foot point 4*a* of said radiator, preferably with a defined torque.

The supply means 21 therefore likewise passes through the holding and/or accommodating device 12 and the support and fixing portion 14.

The supply means 21 is preferably galvanically separated from the external conductor 26 of the plug element 22, and also preferably held or fixed at least in part, by the dielectric 25 (see FIG. 5). The external conductor 26 of the plug element 22 is preferably galvanically connected to the baseplate 2, which consists of a metal or metal alloy or comprises a metal or metal alloy.

So as to expand the field of application of the omnidirectional antenna 1, it preferably further comprises a GNSS module 30, which is shown for example in FIG. 3. The GNSS module 30 is preferably a GPS module which is arranged in the accommodating chamber 8 of the radiator 4 in the end region 4*b* thereof. Preferably, when the omnidirectional antenna 1 is assembled the GNSS module 30 does not actually even extend past the end region 4*b* of the radiator 4, and is thus also preferably located entirely within the accommodating chamber 8. As a result, the construction height is kept low. However, the GNSS module 30 could also project past the end region 4*b* of the radiator 4.

So as to facilitate positioning the GNSS module 30, the omnidirectional antenna 1 comprises at least one support shoulder 31 (see FIG. 5) which extends from the inner face of the radiator 4 into the accommodating chamber 8 thereof. In this context, the GNSS module 30 is positioned on the at least one support shoulder 31. Preferably, the at least one support shoulder 31 comprises a threaded hole so that the GNSS module can be screwed to the support shoulder 31 using a (for example dielectric or metal) screw connection, resulting in a frictional connection.

The GNSS module 30 is preferably a circuit board comprising an antenna structure attached appropriately thereto for receiving position signals emitted via satellites. Preferably, the required electronic components are likewise attached to this GNSS module 30, in such a way that it merely emits a digital signal. The GNSS module 30 is actuated and/or powered via a connection cable 32. This connection cable 32 passes through the baseplate 2 via an opening therein. Preferably, the holding means 10 comprises an accommodating groove 33 (see FIG. 2) which is accessible from the outside, in other words from at least one side, and in which the connection cable 32 is arranged. The accommodating groove 33 preferably extends along the holding means 10 substantially in parallel with the longitudinal axis 5, the accommodating groove 33 extending in the direction of the radiator 4 approximately in parallel with the baseplate 2 at the upper end 10*b* of the holding means 10 and opening into the accommodating chamber 8.

The connection cable 32 can be laid in the accommodating groove 33 without difficulty after assembly. Preferably, it has a cross section slightly larger than the internal diameter of the accommodating groove 33. In this case, the connection cable 32 may be pressed in somewhat, meaning that it cannot slip out of the accommodating groove 33 even if vibrations subsequently occur.

The connection cable 32 preferably extends in part below the accommodating device 12 and also preferably below the support and fixing portion 14 of the accommodating device 12. The accommodating device 12 and in particular the end 14*b* of the support and fixing portion 14 may be screwed into the baseplate 2 using a screw. This takes place after assembly of the connection cable 32 is complete. As a result of the contact pressure thus exerted on the connection cable 32, it is relieved of tension. This means that if on the fully assembled antenna 1 the connection cable 32 is pulled on, this does not result in damage to the antenna 1 or the components it comprises.

The cover hood 20 (see FIGS. 4A, 4B and 5) is form-fittingly and/or frictionally connected to the baseplate 2, and encloses the radiator 4, the holding means 10 and the holding and/or accommodating device 12, and prevents the penetration of moisture. Preferably, the baseplate 2 has a delimiting ridge 35 or corresponding projections. The delimiting ridge 35 or the projections are preferably peripherally closed, and extend in a closed manner around the radiator 4, the holding means 10 and the holding and/or accommodating device 12. In this context, the delimiting ridge 35 engages in a corresponding accommodating groove of the cover hood 20, as is shown in the cross section of FIG. 5.

The delimiting ridge 35 is preferably part of the baseplate 2. The delimiting ridge 35 and the baseplate 2 are therefore preferably manufactured in a single piece, and also preferably in a joint casting process. A sealant is preferably introduced into the accommodating groove of the cover hood 20, preventing moisture from penetrating into the antenna 1. In principle, however, the delimiting ridge 35 too could consist of a rubber or another sealant.

Further, the cover hood 20 is preferably additionally screwed to the baseplate 2. The cover hood 20 consists of a material that is permeable to electromagnetic waves. Preferably exactly a single cover hood 20 is used. The cover hood 20 is further preferably arranged so as not to be in contact with the radiator 4, the holding means 10 and the holding and/or accommodating device 12.

The omnidirectional antenna 1 may be arranged on a rail vehicle or another means of transport. Preferably, however, it is attached to a locomotive, in such a way that reliable communication with said locomotive or with the operating staff is possible. Preferably, the holding means 10 is selected in terms of the diameter thereof and/or the electrical resistance thereof in such a way that the holding means 10 can act as a fuse. This is of significance if an overhead line is released from the anchoring thereof and falls on the broadband antenna 1.

In terms of the fixing openings thereof, which are used for fixing or for cable supply, the baseplate 2 is selected in such a way that these fixing openings are at a distance from one another which is identical to the fixing openings of older baseplates of other broadband antennae. The hole pattern is therefore identical to older antennae. In this case, exchange is possible without difficulty.

In the following, some developments of the broadband omnidirectional antenna 1 are brought to the fore again.

There is an advantage to the broadband omnidirectional antenna 1 if:

a support and fixing portion 14 is provided which is fixed to an outer contour 16 of the shell-shaped or trough-shaped holding and/or accommodating device 12 via connecting elements 15;

a support surface of the support and fixing portion 14 is supported on and/or screwed to and/or riveted to the baseplate 2.

There is an additional advantage to the broadband omnidirectional antenna 1 if:

over at least part of the length of the first portion 6*a* of the radiator 4 this radiator 4 is form-fittingly held by the holding and/or accommodating device 12 at least over part of the periphery.

Further, there is an advantage to the broadband omnidirectional antenna 1 if:

the supply means 21 is galvanically separated from the baseplate 2; and the supply means 21 is connected to the radiator 4 galvanically but without soldering, or is capacitively coupled thereto.

Moreover, there is an advantage to the broadband omnidirectional antenna 1 if:

the supply means 21 comprises at the second end 21*b* thereof an external thread which extends over part of the length of the supply means 21;

via the external thread, the supply means 21 is screwed into the radiator 4 in a corresponding internal thread at the foot point 4*a* of said radiator with a defined torque.

The invention is not limited to the disclosed embodiments. Within the scope of the invention, all the features disclosed and/or shown can be combined with one another as desired.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. Broadband omnidirectional antenna for rail vehicles, comprising:

a baseplate and a monopole radiator, which comprises a foot point and an end region opposite the foot point, the monopole radiator having a longitudinal axis extending predominantly or approximately perpendicularly to the baseplate, wherein the monopole radiator rises from the baseplate, the foot point thereof being arranged closer than the end region thereof to the baseplate, the monopole radiator widening in cross section along the longitudinal axis thereof in at least a first portion located between the foot point thereof and the end region thereof, the monopole radiator comprising diverging walls forming an accommodating chamber;

a shell-shaped or trough-shaped holding and/or accommodating device;

an inner contour of the holding and/or accommodating device being adapted at least over part of the periphery to an outer contour of the first portion of the monopole radiator, resulting in at least part of at least the first portion of the monopole radiator dipping into the holding and/or accommodating device and being held thereby; and a holder, the first end of which is fixed to the baseplate and the second end of which, opposite the first end, being fixed directly or indirectly to the monopole radiator.

2. Broadband omnidirectional antenna according to claim 1, wherein:

the cross section of the monopole radiator remains constant in a second portion, the second portion:

being directly connected to the first portion; or being spaced apart from the first portion by a further portion;

a height of the first portion and of the second portion varying along the longitudinal axis in the peripheral direction of the monopole radiator.

3. Broadband omnidirectional antenna according to claim 1, wherein:

the monopole radiator has an asymmetrical cross section in the cross section thereof transverse to the longitudinal axis thereof, having a cross section in the shape of a part-circle in one sub-region and having a plurality of cross-sectional regions extending in a straight manner in another sub-region; and/or the monopole radiator is conical in one peripheral sub-region and cubic in other peripheral sub-regions; and/or the end region of the monopole radiator is rectangular or square.

4. Broadband omnidirectional antenna according to claim 1, wherein:

at the end region thereof, on at least one face over at least part of the width, the monopole radiator comprises a protruding extension portion which extends along the longitudinal axis in the direction of the baseplate.

5. Broadband omnidirectional antenna according to claim 1, wherein:

the holder is fixed to the end region of the monopole radiator; and the monopole radiator has a connecting portion arranged on the end region of the monopole radiator, the connecting portion extending, with a radial component, outwardly in the manner of a bridge with respect to the longitudinal axis;

the holder is rigidly connected to the end of the connecting portion arranged furthest away from the monopole radiator;

or the holder comprises a connecting portion which, at the upper end of the holder, extends, with a radial component, in the direction of the monopole radiator with respect to the longitudinal axis;

the monopole radiator is rigidly connected to the end of the connecting portion arranged furthest away from the holder.

6. Broadband omnidirectional antenna according to claim 1, wherein:

the monopole radiator consists of metal or a metal alloy or comprises metal or a metal alloy, or it consists of a dielectric, the outer face and/or inner face being provided with an electrically conducive layer;

and/or the holder consists of metal or a metal alloy or comprises metal or a metal alloy;

and/or the holding and/or accommodating device consists of or comprises a dielectric, in particular made of plastics material.

7. Broadband omnidirectional antenna according to claim 6, wherein:

the holder is galvanically connected to the monopole radiator; and/or the holder and the monopole radiator are manufactured in a single piece from a common part and in a joint casting process, or the holder and the monopole radiator consist of two parts which are rigidly connected by being screwed to one another.

8. Broadband omnidirectional antenna according to claim 1, wherein:

the broadband omnidirectional antenna comprises merely a holder; and/or the holder and the holding and/or accommodating device are formations separate from one another which are arranged on the common baseplate.

9. Broadband omnidirectional antenna according to claim 1, wherein:

a supply is arranged at the foot point of the monopole radiator;

the supply extending in the direction of the baseplate;

a plug element, in the form of a socket, is arranged on a lower face of the baseplate which is opposite the mounting face having the accommodated monopole radiator, the plug element being connectable to a power cable;

at least the first end of the supply extending into the plug element, the first end of the supply being designed to accommodate and electrically contact an internal conductor of the power cable.

10. Broadband omnidirectional antenna according to claim 9, wherein:

the supply is galvanically separated from the baseplate;

the supply being connected to the monopole radiator galvanically but without soldering, or is capacitively coupled thereto.

11. Broadband omnidirectional antenna according to claim 1, wherein:

the antenna further comprises a GNSS module, in the form of a GPS module;

the GNSS module being arranged in the accommodating chamber of the monopole radiator in the end region thereof;

when the omnidirectional antenna is assembled, the GNSS module does not extend past the end region of the monopole radiator or is located at least predominantly or entirely within the accommodating chamber.

12. Broadband omnidirectional antenna according to claim 11, wherein:

the monopole radiator comprises at least one support shoulder which extends from the inner face of the monopole radiator into the accommodating chamber thereof;

the GNSS module being supported on the at least one support shoulder.

13. Broadband omnidirectional antenna according to claim 12, wherein:

the at least one support shoulder comprises a threaded hole;

the GNSS module being screwed to the support shoulder via a screw connection.

14. Broadband omnidirectional antenna according to claim 11, wherein:

the holder comprises an accommodating groove which is accessible from the outside;

the connection cable for powering the GNSS module being arranged in the accommodating groove.

15. Broadband omnidirectional antenna according to claim 14, wherein:

the accommodating groove continues in the baseplate, the connection cable being arranged in the accommodating groove in the baseplate and being covered at least in part by the accommodating device;

when the omnidirectional antenna is assembled, a contact pressure is exerted on the connection cable by the accommodating device, causing the connection cable to be relieved of tension;

and/or the antenna further comprising an accommodating and fixing portion which is fixed to an outer contour of the shell-shaped or trough-shaped holding and/or accommodating device via connecting elements;

a support surface of the support and fixing portion being supported on and/or screwed to the baseplate;

the accommodating groove continuing in the baseplate, the connection cable being arranged in the accommodating groove in the baseplate and being covered at least in part by the support and fixing portion;

when the omnidirectional antenna is assembled, a contact pressure is exerted on the connection cable by the support and fixing portion, causing the connection cable to be relieved of tension.

16. Broadband omnidirectional antenna according to claim 1, further comprising:

merely one cover hood, the cover hood being connected to the baseplate form-fittingly and/or frictionally and additionally in a moisture-proof manner, and enclosing the monopole radiator, the holder and the holding and/or accommodating device;

the cover hood being arranged so as not to be in contact with the monopole radiator, the holder and the accommodating device.

17. Broadband omnidirectional antenna according to claim 11, further comprising:

merely one cover hood;

the cover hood being connected to the baseplate form-fittingly and/or frictionally and additionally in a moisture-proof manner, and encloses the monopole radiator, the holder and the holding and/or accommodating device;

the cover hood is arranged so as not to be in contact with the monopole radiator, the holder and the accommodating device;

a spring element arranged between the cover hood and either the end region of the monopole radiator or the GNSS module, a spring force of the spring element holding the GNSS module in position within the accommodating chamber.

18. Broadband omnidirectional antenna according to claim 1, wherein:

the baseplate comprises a plurality of fixing and/or passage openings, which are for fixing and/or passing cables through on a rail vehicle, a hole pattern for these openings corresponding to a hole pattern of a baseplate of previous antennae so as to make an exchange possible.

19. Rail vehicle, in the form of a locomotive or an underground train or a tram or a carriage, wherein the rail vehicle comprises at least one broadband omnidirectional antenna for communication, wherein the broadband omnidirectional antenna is of a construction according to claim 1.

20. Rail vehicle according to claim 19, wherein:

the rail vehicle is driven electrically, the electrical power being drawn or drawable from an overhead line;

the holder being selected in terms of the diameter thereof and/or the electrical resistance thereof in such a way that it acts as a fuse if the overhead line is released from the anchoring thereof and falls on the broadband antenna.

* * * * *